US008540579B2

(12) United States Patent
Richard et al.

(10) Patent No.: US 8,540,579 B2
(45) Date of Patent: Sep. 24, 2013

(54) METHOD AND APPARATUS FOR THE IDENTIFICATION AND POSITION MEASUREMENT OF CHIPS ON A GAMING SURFACE

(76) Inventors: Christian Richard, Dorval (CA); Ron N. Miller, Toronto (CA)

( * ) Notice: Subject to any disclaimer, the term of this patent is extended or adjusted under 35 U.S.C. 154(b) by 1036 days.

(21) Appl. No.: 12/090,718

(22) PCT Filed: Oct. 20, 2006

(86) PCT No.: PCT/CA2006/001716

§ 371 (c)(1),
(2), (4) Date: Nov. 25, 2008

(87) PCT Pub. No.: WO2007/045092

PCT Pub. Date: Apr. 26, 2007

(65) Prior Publication Data

US 2009/0221364 A1 Sep. 3, 2009

Related U.S. Application Data

(60) Provisional application No. 60/728,761, filed on Oct. 21, 2005.

(51) Int. Cl.
*A63F 9/24* (2006.01)
*A63F 9/34* (2006.01)

(52) U.S. Cl.
USPC ..... 463/46; 463/25; 463/27; 273/274; 273/309; 340/10.1

(58) Field of Classification Search
USPC ..... 463/12, 16, 25, 29, 46, 47; 273/236–239, 273/274, 148 R, 288, 309; 340/10.1–10.6; 455/1; 343/722, 832
See application file for complete search history.

(56) References Cited

U.S. PATENT DOCUMENTS

| | | | | |
|---|---|---|---|---|
| 3,766,494 | A * | 10/1973 | Anbe et al. | 331/99 |
| 5,510,756 | A * | 4/1996 | Arnold et al. | 333/223 |
| 5,651,548 | A * | 7/1997 | French et al. | 463/25 |
| 5,941,769 | A * | 8/1999 | Order | 463/12 |
| 6,530,837 | B2 * | 3/2003 | Soltys et al. | 463/29 |

(Continued)

OTHER PUBLICATIONS

PCT International Search Report (PCT/CA2006/001716).

(Continued)

*Primary Examiner* — Damon Pierce
(74) *Attorney, Agent, or Firm* — Pierce Atwood LLP; Kevin M. Farrell; David J. Wilson

(57) ABSTRACT

The present invention is directed to a method for determining a position of each of a plurality of gaming chips on a gaming surface. Each of the plurality of gaming chips includes an inductively coupled RFID tag disposed therein. The gaming surface includes a first area and at least one second area disposed adjacent to the first area. The method includes transmitting a near-field inductively coupled interrogation signal to the plurality of gaming chips. A near-field inductively coupled response signal is received from at least a portion of the plurality of gaming chips. A position resolution action is performed in conjunction with either the step of transmitting or the step of receiving. Each of the plurality of gaming chips are associated with either the first area or the at least one second area in accordance with the step of performing a position resolution action.

25 Claims, 6 Drawing Sheets

(56) References Cited

U.S. PATENT DOCUMENTS

| | | | | |
|---|---|---|---|---|
| 7,253,717 | B2 * | 8/2007 | Armstrong et al. | 340/10.2 |
| 7,753,779 | B2 * | 7/2010 | Shayesteh | 463/25 |
| 7,931,204 | B2 * | 4/2011 | Chapet | 235/492 |
| 8,187,075 | B2 * | 5/2012 | Koyama | 463/17 |
| 2005/0212673 | A1 * | 9/2005 | Forster | 340/572.7 |
| 2008/0113764 | A1 * | 5/2008 | Soltys | 463/22 |
| 2009/0115133 | A1 * | 5/2009 | Kelly et al. | 273/274 |

OTHER PUBLICATIONS

PCT Written Opinion of the International Search Authority (PCT/CA2006/001716).

* cited by examiner

METHOD AND APPARATUS FOR THE IDENTIFICATION AND POSITION MEASUREMENT OF CHIPS ON A GAMING SURFACE

CROSS-REFERENCE TO RELATED APPLICATIONS

This is a U.S. National Stage submission under 35 U.S.C. §371 of International Patent Application Serial No. PCT/CA2006/001716 filed on 20 Oct. 2006, International Patent Application Serial No. PCT/CA2006/001716 claims priority under 35 U.S.C. §119 (e) to U.S. Provisional Patent Application Ser. No. 60/728,761 filed on 21 Oct. 2005, the contents of which are relied upon and incorporated herein by reference in their entirety.

1. FIELD OF THE INVENTION

The present invention relates to a method and apparatus for the identification and position measurement of chips on a gaming surface. More specifically, the present invention relates to a method and system for improving the spatial resolution of magnetic coupling RFID technology to identify and measure the position of chips on precisely defined betting areas on a gaming table.

2. TECHNICAL BACKGROUND

Casino managers have always been interested in being able to record in real time all the bets occurring within their premises. To do so a precise and reliable means of identifying the various chips (gaming tokens) placed inside and outside the betting zones, as indicated by gaming surface (gaming table) markings, is required.

Such capability has, up to now, been impossible to achieve, within reasonable budgets and with existing technologies, but it nevertheless still remains extremely high in the list of the casino managers' priorities. For example, such capability, combined with appropriate software, could allow the real-time automatic flagging of unusual events, the continuous tracking of the performance of individual players, as well as the assessment of the short, medium and long-term performance of casino personnel.

During the past years, several approaches have been proposed to achieve this objective. In particular, approaches specifically based on radio frequency identification (RFID) technology have been patented. However, although promising, this technology presents a major drawback: it is not particularly precise in terms of spatial resolution and, as a result, its potential is limited to gaming surfaces with single betting areas, such as poker tables, or to tables with very spaced out betting areas.

In fact, a commonly used type of RFID technology is based on radiated fields (far fields) operating at approved frequencies such as 433 MHz, 915 MHz, 2.4 GHz etc. Because of both its operating principle and the frequencies at which it operates, this technology is subject to effects that disturb the local field. For example antennas may be detuned by parasitic capacitance (people and metal objects), signals may be attenuated by the human body, and propagation may be affected by multi-path phenomena. Consequently, it is easy to see why, when dealing with gaming surfaces with multiple, closely spaced, betting areas, such as the ones used in blackjack or baccarat, or, even worse, with gaming surfaces in which chips may legitimately ride on the separation lines between betting areas, such as roulette tables, existing RFID based technology is inadequate.

Magnetic coupling RFID based technology, operating at approved frequencies in the 125 KHz or 13.56 MHz bands, has been proposed to overcome these spatial resolution limitations. Because of the inherent "near field" characteristics of this technology, the signal dies off very rapidly beyond the intended coverage area and surrounding environment variations have much less of an impact.

However, even though this technology is clearly superior to other existing RFID technology, it may not be, by itself, used to achieve accurate enough coverage over closely spaced betting zones. In fact, this is due to another requirement imposed by casinos: as chips may be stacked on top of each other, the technology has to allow communication with a chip on top of a stack, which may actually be up to 25 chips high. The magnetic field produced by an embedded loop is roughly spherically shaped and its "drop off" characteristics are determined by physics and may be expressed in dB/mm. To extend itself high enough to read the chips at the top of a stack, the magnetic field inevitably has to extend laterally as well. This implies that when the diagonal of the betting area is smaller than the height of the top of a 25 chip stack, and that an adjacent betting area is situated quite close to the observed betting area, it is generally impossible to achieve the required "drop off" characteristics.

SUMMARY OF THE INVENTION

The present invention addresses the needs described above by accurately determining the position of a plurality of gaming chips disposed in closely spaced betting zones on a blackjack gaming table.

One aspect of the present invention is directed to a method for determining a position of each of a plurality of gaming chips on a gaming surface. Each of the plurality of gaming chips includes an inductively coupled RFID tag disposed therein. The gaming surface includes a first area and at least one second area disposed adjacent to the first area. The method includes transmitting a near-field inductively coupled interrogation signal to the plurality of gaming chips. A near-field inductively coupled response signal is received from at least a portion of the plurality of gaming chips. A position resolution action is performed in conjunction with either the step of transmitting or the step of receiving. Each of the plurality of gaming chips are associated with either the first area or the at least one second area in accordance with the step of performing a position resolution action.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
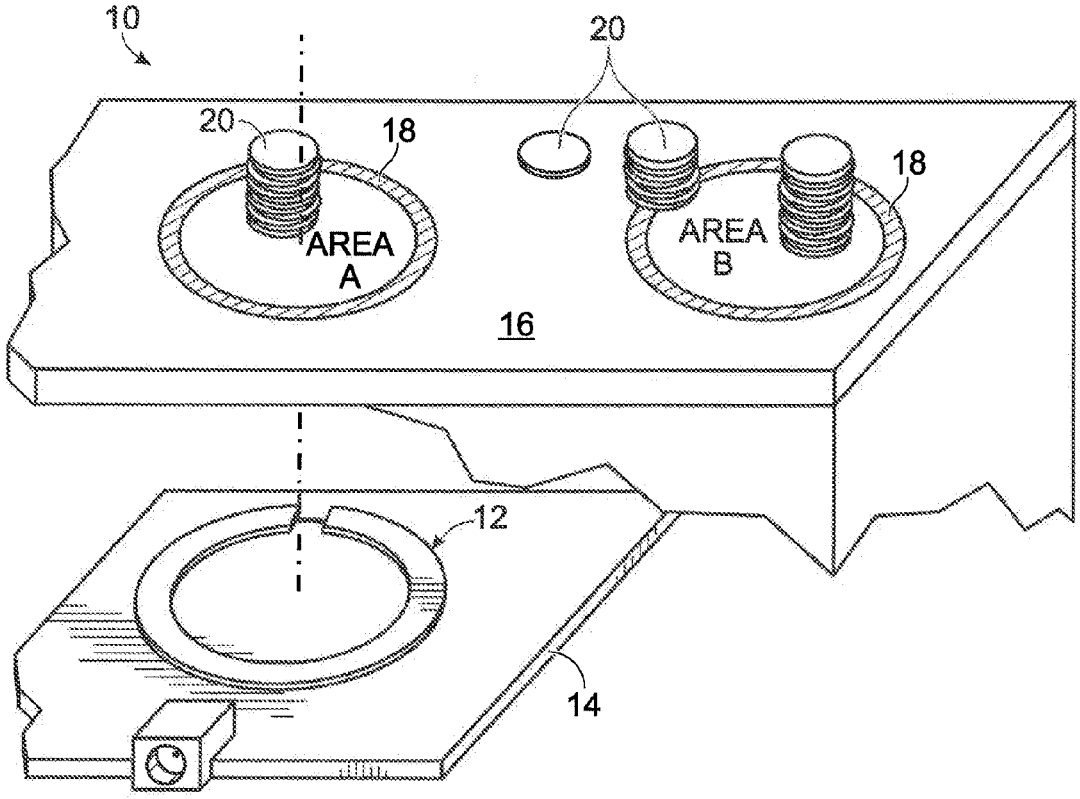
FIG. 1 is a schematic illustration of a gaming table.

Reference will now be made in detail to the present exemplary embodiments of the invention, examples of which are illustrated in the accompanying drawings. Wherever possible, the same reference numbers will be used throughout the drawings to refer to the same or like parts. An exemplary embodiment of the gaming surface of the present invention is shown in FIG. 1, and is designated generally throughout by reference numeral 10.

Generally stated, a method and apparatus according to illustrative embodiments of the present invention provide improved spatial resolution of magnetic coupling RFID technology used to identify the position of chips on precisely defined betting areas on a gaming surface, such as, for example, a gaming table. The method and apparatus provide gaming surface modifications which allow the use of magnetically coupled RFID gaming chips where tight spacing is needed and no "cross reading" of chips in other betting zones is desired. The use of "active field control" methods that consist of jamming loops, field shaping loops, ferrite solenoids and enhanced RFID measurements within the chip are described.

Referring to FIG. 1, a common gaming surface which uses magnetic coupling technology is shown in the form of a gaming table 10 having betting areas A and B. The basic components of the gaming table 10 include a coil inductive coupler 12 with corresponding electronic circuitry 14 associated with each betting area (for the sake of clarity only those of betting area A are shown), a protective cover 16 with betting area markings 18 applied thereon and gaming chips 20, all of which will be further detailed below. As those of ordinary skill in the art will appreciate, the coil inductive coupler 12 with corresponding electronic circuitry 14 may be referred to as the RFID interrogator assembly.

The coiled inductive coupler 12, referred to as the primary coil, is installed within the gaming table 10 and produces the read zone covering its associated betting area A, B within which gaming chips 20 have to be identified and counted.

The electronic circuitry 14 produces the current flowing through the primary coil 12 and interprets (reads) the different signals induced by magnetic coupling in the primary coil 12 by gaming chips 20 placed inside an associated betting area A, B.

The protective cover 16, which may be, for example, a plastic sheet with felt carpeting, covers the primary coil 12 and its corresponding electronic circuitry 14, and also provides a surface on which the betting area markings 18 may be applied and the chips 20 placed.

Each of the gaming chips 20 integrate a coiled inductive coupler, referred to as the secondary coil, through which currents induced by magnetic coupling from the gaming table 10 primary coil 12 and by the other gaming chips 20 secondary coils flow, and an integrated circuit containing the appropriate gaming chip identification data, the circuit being capable of generating signals which may be used to transmit such data by magnetic coupling.

It is to be understood that although the primary coil 12 and complementary electronic circuitry 14 of betting area A have been discussed, the same apply to any other betting area such as, for example, betting area B.

Figure 2:
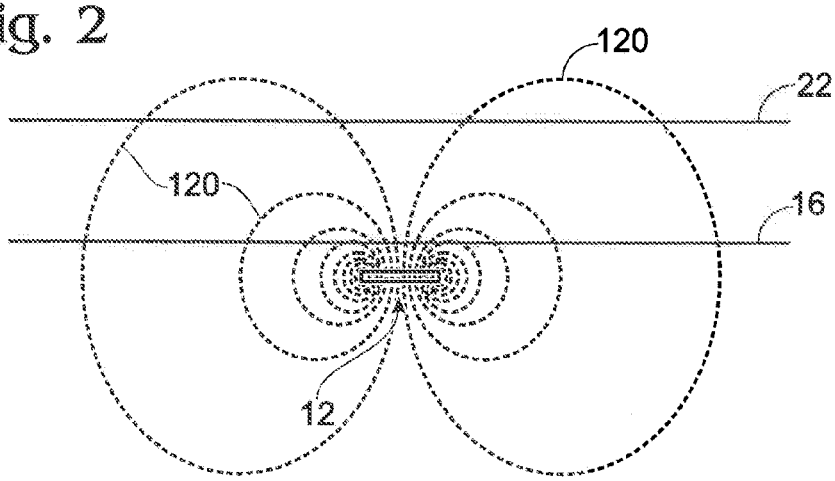
FIG. 2 is a diagram of the magnetic flux lines of a coiled inductive coupler.
Figure 3:
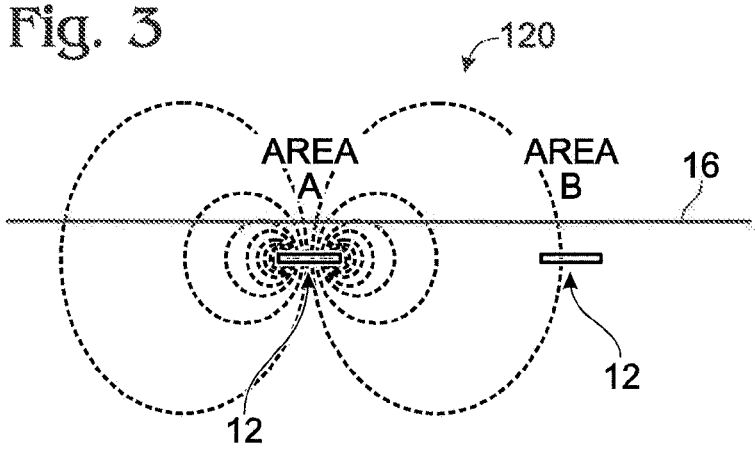
FIG. 3 is a diagram of the magnetic flux densities of a coiled inductive coupler.

Referring to FIG. 2, the magnetic flux 120 produced by the primary coil 12 is roughly spherically shaped and its "drop off" characteristics are determined by physics and may be expressed in dB/mm. To extend itself high enough to read chips at the top of a stack, such as the height of a 25 chip stack identified by line 22, the magnetic field inevitably has to extend laterally as well. This implies that when the diagonal of the betting area is smaller than the height of the top of a 25 chip stack, and that an adjacent betting area is situated quite close to the observed betting area, it is generally impossible to achieve the required "drop off" characteristics. Referring now to FIG. 3, it may be seen that the magnetic flux 120 produced by the primary coil 12 of betting area A extends laterally, although with reduced density, into adjacent betting are B.

In order to achieve improved chip 20 position measurement (0.5 inch or better), especially when the specification calls for stacks of up to 25 chips 20, magnetic coupling technology may be combined with one or more complementary components and method of use thereof, either based on active field control using jamming coils or ferrite induced field deformation or on additional measurement techniques, such as received signal strength information (RSSI).

Figure 4:
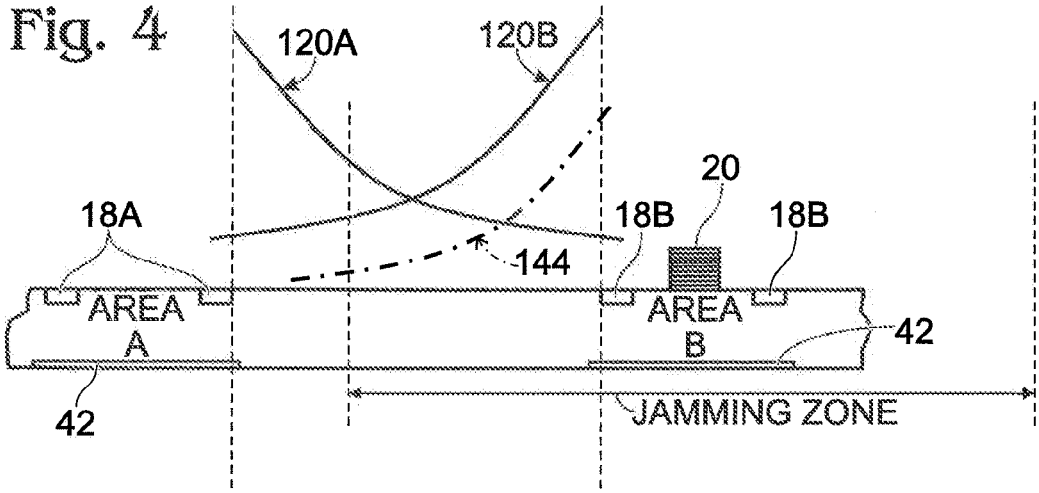
FIG. 4 is a schematic representation of the jamming concept.
Figure 5:
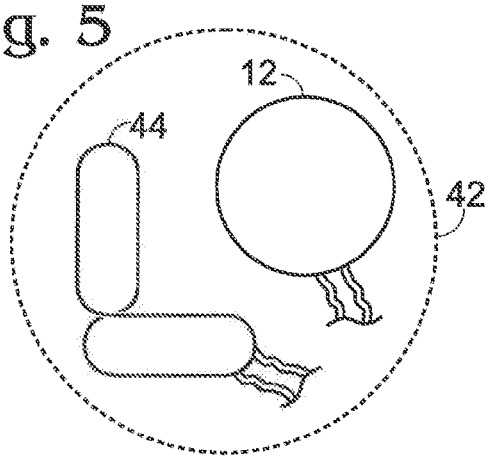
FIG. 5 is a schematic representation of a coil set used in the jamming concept of FIG. 4.
Figure 6:
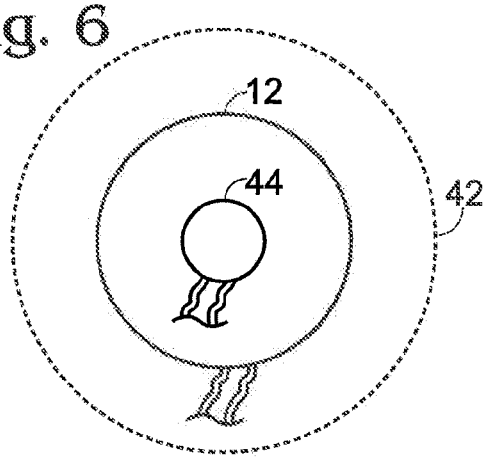
FIG. 6 is a schematic representation of an alternative coil set used in the jamming concept of FIG. 4.

Referring to FIGS. 4, 5 and 6, coil sets 42 comprising a primary coil 12, referred to as the "read" coil, and one or more jamming coils 44, one such set 42 being associated with each betting area A, B, may be used. To identify the gaming chips 20 within a specific betting area, the jamming coils 44 of all or some of the coil sets 42 are activated apart from the set situated in the betting area being observed. By cyclically multiplexing the jamming coils 44, so as to serially observe each of the betting areas A, B; it is possible to precisely draw the complete picture of the bets on the gaming table 10 (or any other gaming surface). The jamming coils 44 may be "lateral" i.e. adjacent to and in the same plane as the read coil 12, such as shown in FIG. 5, or concentric to and in the same plane as the read coil 12, such as shown in FIG. 6. When concentric jamming coils 44 are used, two "read" operations are required; one when the jamming coils 44 are energized and one when they are not. The gaming chips 20 in the betting area may be found by subtracting the two lists of chips 20 obtained.

In a first illustrative embodiment, shown in FIG. 5, the jamming coil 44 is adjacent and in the same plane as the read coil 12, and is in the form of circuit loops of various geometries, which may include field canceling crossover patterns referred to as a "jammer loop".

In another illustrative embodiment, the coil set 42 may comprise a first circular, oval or square read coil 12 with a second concentric circular, oval or square jamming coil 44, which is in the same plane and co-axial to the read coil 12. FIG. 6 shows an example where both the read coil 12 and jamming coil 44 are concentric circular coils.

In a further illustrative embodiment (not shown), the coil set 42 may comprise an auxiliary coil associated with the read coil 12, actively energized and phase coherent with the read coil 12 excitation, to shape the magnetic field of the read coil 12.

Read coils 12 in the gaming table 10 (or other gaming surface) are used to sense chips 20 in the betting areas A, B associated with each read coil 12 and are scanned in turn by a multiplexer. Associated with each read coil 12 are jamming coils 44 disposed as described above. The jamming coils 44 are activated to help restrict the reading zone of the read coil 12 by either splitting the signal and shaping the resulting field pattern or by generating a separate independent jamming signal. Referring back to FIG. 4, there is shown the read coil flux 120A associated with betting area A and the read coil flux 120B associated with betting area B. As it may be seen, when activated the read coil 12 of betting area A generates a flux 120A that extends into betting area B delimited by betting area markings 18B. When activated, the jamming coil 44 of betting area B generates a jamming flux 144 that prevents the read coil 12 from betting area A to read chips 20 located in betting area B. The jamming signal 144 may only be, for example, an in-band 13.56 MHz continuous wave (CW) signal at a level or 10 dB below the normal reader coil 12 received level. It is to be understood that other jamming modulations are possible depending on the RFID chip technology used.

A further method is to use jamming coils 44 of various shapes to produce local area jamming signals that prevent chips 20 outside of the betting area being read from hearing and responding to the interrogation signals of the reader coil 12.

Using multiple active coils or specially shaped ferrite solenoids modifies the gaming surface 16 magnetic field so as to increase the drop-off slope around each betting area, A, B. By doing so the magnetic field around each betting area A, B may actually assume a more "rectangular shape" rather than "quasi-spherical". Moreover, by combining this technique with the multiplexing of the active coils or the solenoids it may also be possible to further enhance the position accuracy of this improvement.

Figure 7:
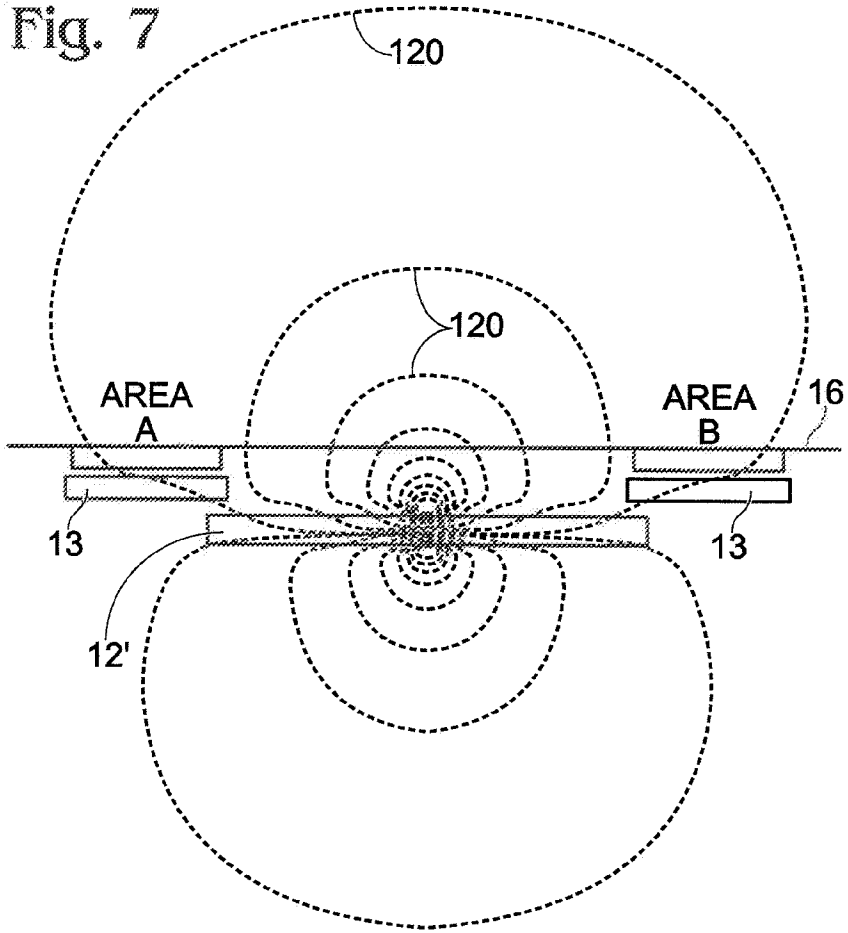
FIG. 7 is a diagram of the magnetic flux lines of a ferrite solenoid combined with ferrite director material.

In a first illustrative embodiment, shown in FIG. 7, a horizontal ferrite solenoid rod 12' is used, instead of a coiled inductive coupler, below the plane of the gaming surface 16 and is placed in between two betting areas, here betting areas A and B. This construction produces a magnetic flux pattern 120 such that it passes perpendicularly up through one read zone (for example betting area B) and down through a second laterally adjacent read zone (for example betting area A). A ferrite director material 13 may be placed horizontally beneath the gaming surface 16 under each betting area A, B to widen the magnetic flux 120.

Figure 8:
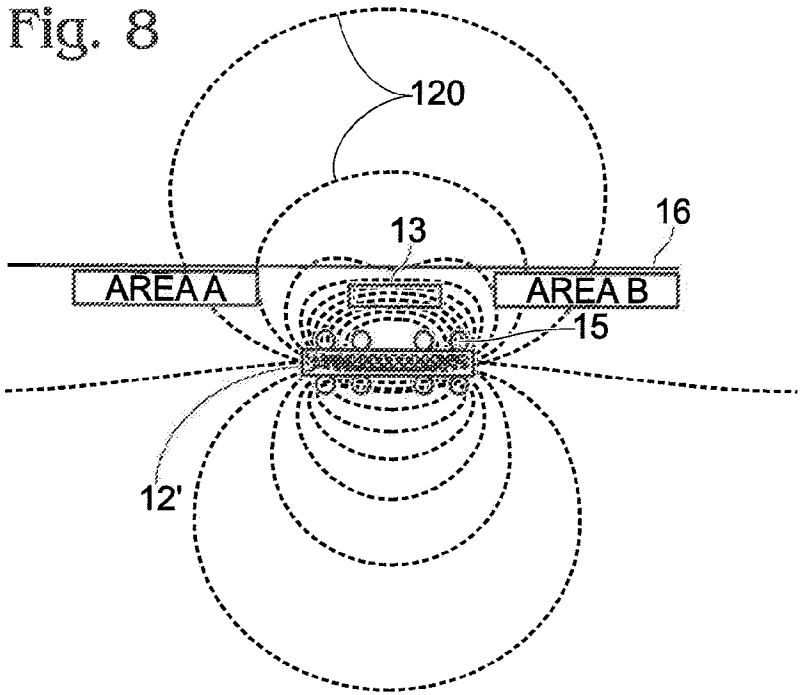
FIG. 8 is a diagram of the magnetic flux lines of a wounded ferrite solenoid combined with a ferrite field flattening plate.

In another illustrative embodiment, shown in FIG. 8, a specially shaped ferrite solenoid 12' with an excitation winding 15 is used, instead of a coiled inductive coupler 12, below the plane of the gaming surface 16 and is placed in between two betting areas, here betting areas A and B. This construction produces a magnetic flux pattern 120 such that it passes perpendicularly up through one read zone (for example betting area B) and down through a second laterally adjacent read zone (for example betting area A). A ferrite director material 13 may be placed between the adjacent read zones, here betting areas A and B, to help ensure that the lines of magnetic flux 120 are more horizontal in the region where chips are not to be read. Flux 120 crossing through chips not in the read zones is minimized and consequently these chips may not be excited and read.

Figure 9:
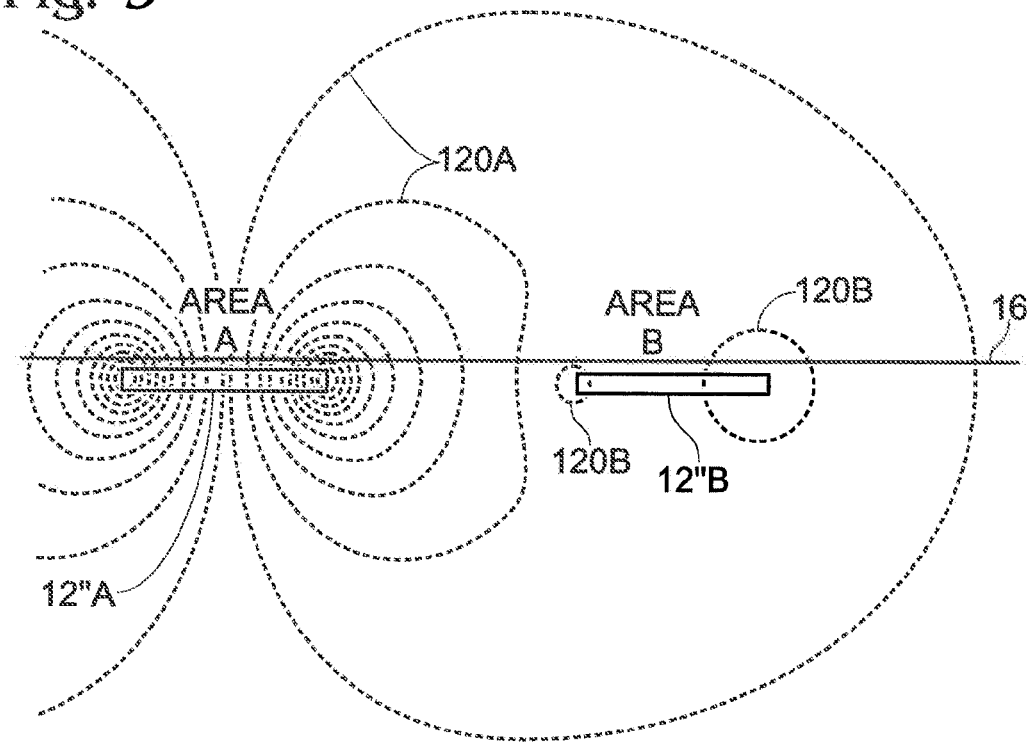
FIG. 9 is a diagram of the magnetic flux lines of two coiled inductive couplers combined in an active field shaping configuration.

In a further illustrative embodiment, shown in FIG. 9, an active inductive coupler coils 12"A, 12"B are used under respective betting area A, B in order to shape the magnetic field. For example, suppose betting area A is being read, then active inductive coupler coil 12"A generates flux 120A. In order to shape flux 120A so that it does not extend into the adjacent betting area, here betting area B, active inductive coupler coil 12"B is used to generate a small signal in phase, and at the same frequency, as that of active inductive coupler coil 12"A, thus producing flux 120B which "pushes" flux 120A back towards betting area A.

Figure 10:
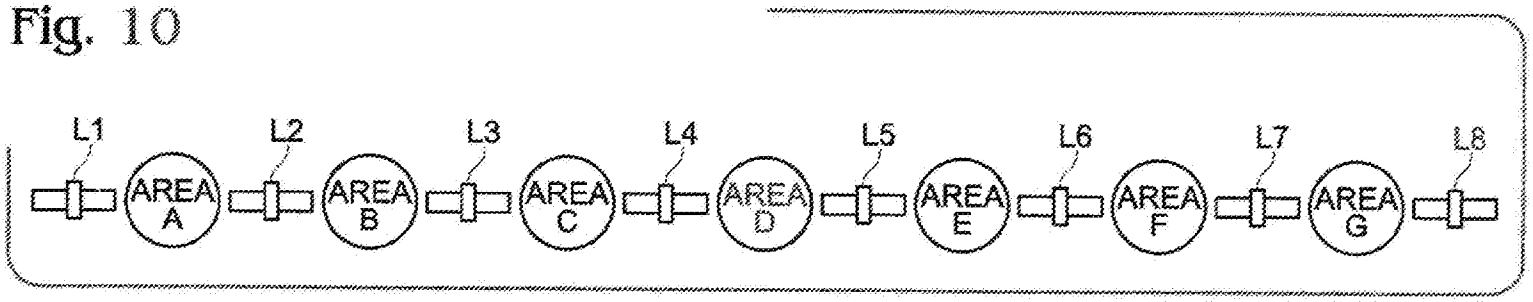
FIG. 10 is a schematic representation of the placement of ferrite solenoids under a gaming surface.

Referring to FIG. 10, several multiplexed horizontally placed ferrite solenoids, L1 though L8, are used, each interrogating only one or two betting areas at a time. For example, ferrite solenoid L2 interrogates betting areas A and B. Since the end zones contain only one betting area each, namely betting areas A and G, the exact count of chips in each of the zones may be found by logical deduction. For example, ferrite solenoid L1 reads the chips contained in betting area A, creating list A, while ferrite solenoid L2 reads the chips contained in betting areas A and B, creating list AB. To obtain the list of chips contained solely in betting area B, that is list B, it suffice to subtract list A from list AB. Similarly, list C is obtained by subtracting list B from list BC obtained when ferrite solenoid L3 reads the chips contained in betting areas B and C. This is repeated until the list of chips in each betting area is determined. It is to be understood that this method may be used with a lesser number of ferrite solenoids, for example using only ferrite solenoids L1, L2, L4, L5, L6 and L8, but ferrite solenoid L3 and L7 may be used for redundancy purposes in this case.

By introducing field measurement capability using received signal strength indication (RSSI) within the gaming chips and by knowing the exact field intensity level at each gaming chip, it is possible to calculate its distance from the device producing the magnetic field. By triangulation, i.e. by calculating the intersection of the circles situated at the distance corresponding to the measured field strength in three different field cases the exact position of the token may be determined. The three different field cases contemplated above may actually be produced, for example, by using three different devices situated in different locations or by a central device and additional devices that modify the magnetic field gradient.

Figure 11:
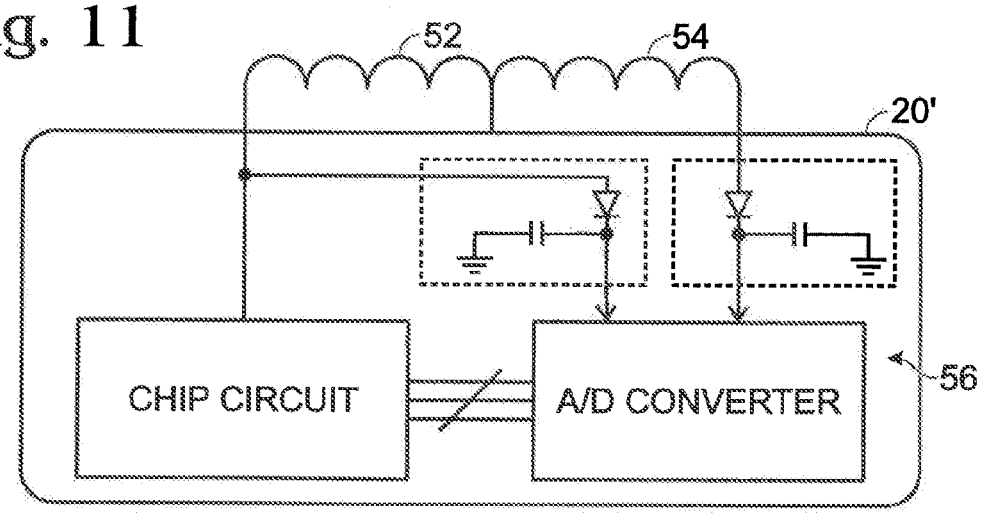
FIG. 11 is a schematic representation of the internal circuits of a modified RFID gaming chip.
Figure 12:
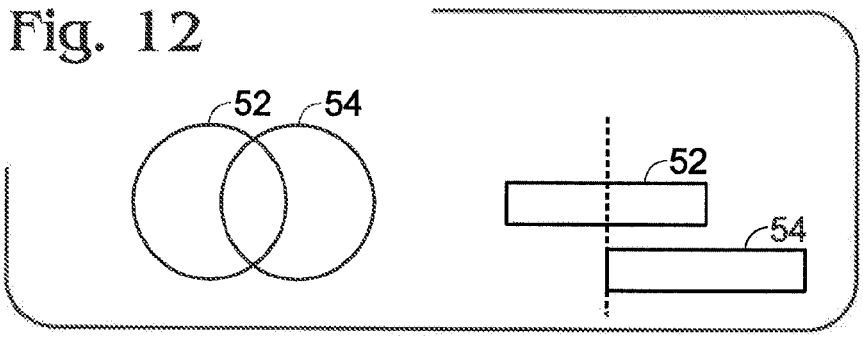
FIG. 12 is a schematic representation of the positioning of the coiled inductive couplers of the circuit shown in FIG. 11.

In a first illustrative embodiment, shown in FIG. 11, a gaming chip 20' contains two side by side overlapping inductive coupler coils 52, 54, and an RFID integrated circuit 56 capable of measuring the RSSI and communicating this measure as data along with its usual unique internal 10. The inductive coupler coils 52, 54 are overlapped, as shown in FIG. 12, in such a way as to reduce mutual inductance.

Figure 13:
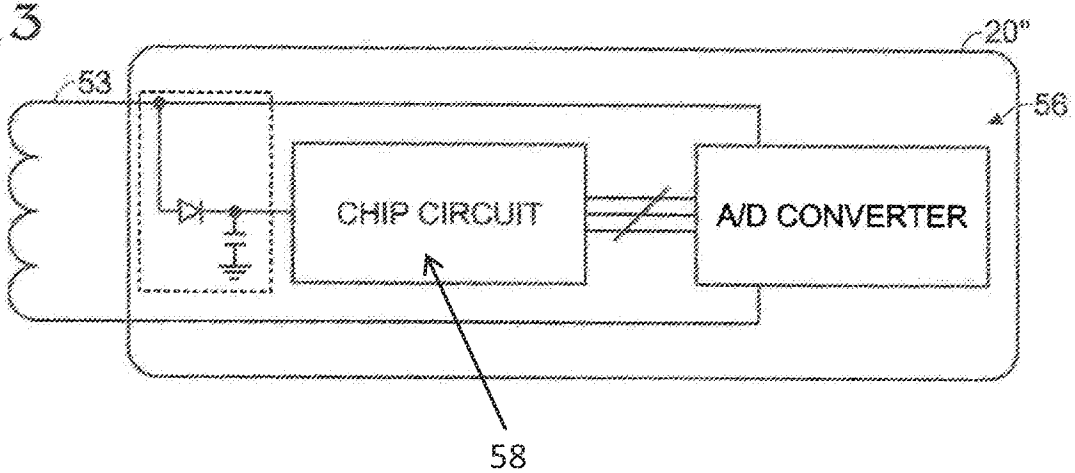
FIG. 13 is a schematic representation of the internal circuits of another modified RFID gaming chip.

In another illustrative embodiment, shown in FIG. 13, a gaming chip 20" contains a single coupler coil 53 and an RFID integrated circuit 58 capable of measuring the RSSI and communicating this measure as data along with its usual unique internal identification number (10), is used.

To determine the position of a chip 20' containing two side by side overlapping inductive coupler coils 52, 54, the gradient of the magnetic induction field of the reader coil 12 is sensed by differencing the levels measured from each inductive coupler coil 52, 54 and dividing by their known separation distance. This gradient is then compared to calibrated radial measurements. Hence distance from the center of the betting area, which is usually circular in shape, may be determined.

The method to determine the position of a chip 20" containing a single inductive coupler coil 53 is to use the difference in RSSI as a measure of the values of the magnetic field produced by a single reader coil, which may be calibrated to the position of the gaming chip 20" on the gaming surface 16.

Figure 14:
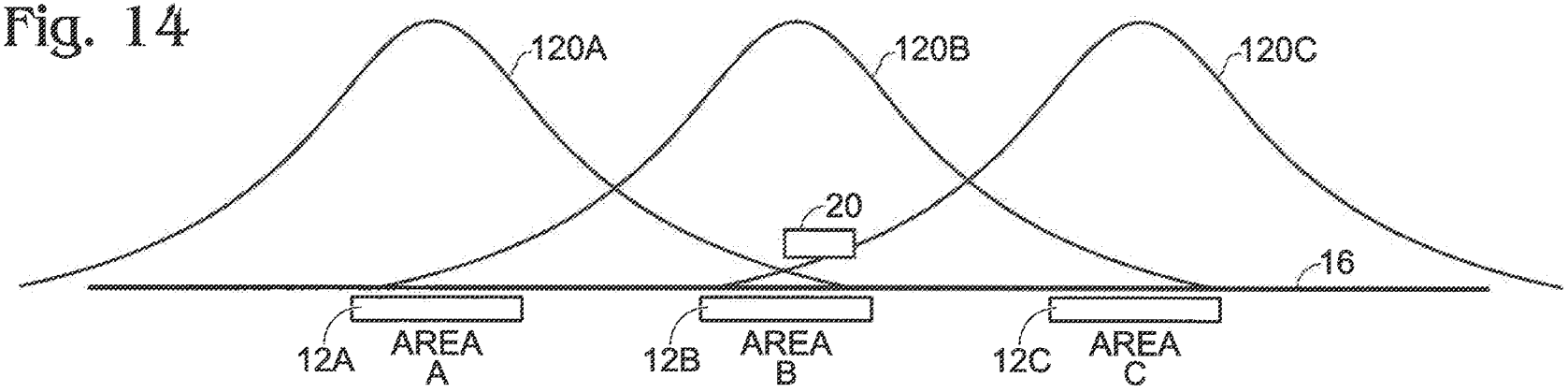
FIG. 14 is a schematic representation of the flux density profiles of adjacent coiled inductive couplers.
Figure 15:
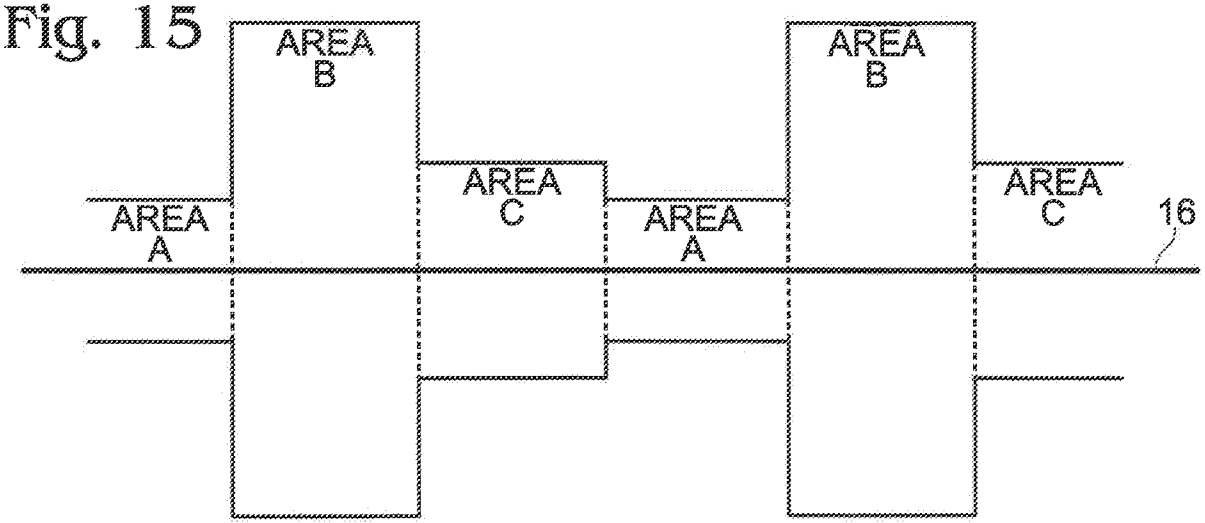
FIG. 15 is a schematic representation of the signal envelop received at each coiled inductive coupler.

Furthermore, signals from two or more interrogating read coils 12 may be used to measure the position of a chip 20. Referring to FIG. 14, chip 20 senses the relative levels of the fields 120A, 120B and 120C generated by read coils 12A, 12B and 12C, respectively, as they are sequentially energized. This data, shown in FIG. 15, may then be used to form a distance measurement from the intersection of the field patterns and may be calibrated to a position on the gaming surface 16.

Although the present invention has been described by way of illustrative embodiments and examples thereof, it should be noted that it will be apparent to persons skilled in the art that modifications may be applied to the present illustrative embodiments without departing from the scope of the present invention. Furthermore, it is to be understood that the approaches described above may find applications other than gaming or betting surfaces and tables. In particular, they may be used in various "smart shelf" type applications to find and locate small closely spaced RFID tagged items such as, for example, test tubes; pill bottles; biological or forensic sample holders; stacks of documents, gem stone sample bags, etc.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A method for determining a position of each of a plurality of gaming chips on a gaming surface, each of the plurality of gaming chips including an inductively coupled radio frequency identification (RFID) tag disposed therein, the gaming surface including a first area and at least one second area disposed adjacent to the first area, the method comprising:

transmitting a near-field inductively coupled interrogation signal to the plurality of gaming chips;

receiving a near-field inductively coupled response signal from at least a portion of the plurality of gaming chips;

performing a position resolution action in either the step of transmitting or the step of receiving, wherein the position resolution action is performed by at least two position resolution elements, further wherein the at least two position resolution elements include at least one of an active auxiliary coil or a specifically shaped ferrite solenoid for restricting an interrogation area; and associating each of the plurality of gaming chips with either the first area or the at least one second area in accordance with the step of performing a position resolution action.

2. The method of claim 1, wherein the step of transmitting is performed by at least one RFID interrogator assembly disposed under the gaming surface.

3. The method of claim 1, wherein a first RFID interrogator assembly is disposed under the first area and at least one second RFID interrogator assembly is disposed under the at least one second area.

4. The method of claim 3, wherein a jammer device is disposed between the first RFID interrogator and the at least one second RFID interrogator assembly.

5. The method of claim 3, wherein the first RFID interrogator and the at least one second RFID interrogator assembly include a first reader coil and at least one second reader coil, respectively, and wherein a jammer coil is disposed concentrically with the first reader coil, the at least one second reader coil and/or both.

6. The method of claim 3, wherein the step of performing a position resolution action includes actively jamming the first RFID interrogator assembly such that the first RFID interrogator assembly receives near-field inductively coupled response signals from gaming chips disposed in the first area.

7. The method of claim 6, wherein the first RFID interrogator is actively jammed by the at least one second RFID interrogator assembly.

8. The method of claim 7, wherein the first RFID interrogator is actively jammed by a jammer coil.

9. The method of claim 3, wherein the step of performing a position resolution action includes actively jamming the at least one second RFID interrogator assembly such that the at least one second RFID interrogator assembly receives near-field inductively coupled response signals from gaming chips disposed in the at least one second area.

10. The method of claim 9, wherein the at least one second RFID interrogator is actively jammed by an adjacent RFID interrogator assembly.

11. The method of claim 10, wherein the at least one second RFID interrogator is actively jammed by a jammer coil.

12. The method of claim 3, wherein the step of performing a position resolution action includes generating an active field shaping signal in the at least one second area simultaneous with the transmission of the near-field inductively coupled interrogation signal by a first reader assembly, the active field shaping signal being phased to direct the near-field inductively coupled interrogation signal away from the at least one second area such that gaming chips disposed in the at least one second area are not interrogated.

13. The method of claim 12, wherein the active field shaping signal is generated by a ferrite solenoid device.

14. The method of claim 1, wherein the at least one second area includes a plurality of second areas such that the first area and the plurality of second areas comprise N areas, and wherein an RFID interrogator assembly is disposed in a near-field region adjacent each of the N areas such that N+1 RFID interrogator assemblies are interleaved with the N areas such that the first RFID interrogator assembly is disposed adjacent to the first area and an $N+1^{st}$ RFID interrogator assembly is disposed adjacent the $N^{th}$ area, RFID interrogator assemblies 2 through N being adjacent to areas on either side, N being an integer.

15. The method of claim 14, wherein the step of performing a position resolution action includes having each of the N+1 RFID interrogators transmitting an inductively coupled interrogation signal to adjacent areas disposed in a reader near-field and receiving near-field inductively coupled response signals from gaming chips disposed in the reader near-field.

16. The method of claim 15, wherein the step of associating further comprises: associating each near-field inductively coupled response signal with a corresponding gaming chip and one of the N+1 RFID interrogators; forming N+1 lists of gaming chips in accordance with the step of associating; and comparing the N+1 lists of gaming chips to thereby associate each gaming chip with one of the N areas.

17. The method of claim 15, wherein each of the N+1 RFID interrogators include a ferrite solenoid device and a ferrite strip element configured to direct the inductively coupled interrogation signal to conform to a predetermined transmission pattern field shape so that only 2 areas are interrogated.

18. The method of claim 1, wherein the at least one second area includes a second area adjacent to the first area and a third area adjacent to the second area, the first area, second area, and third area comprising at least one reading zone, and wherein a first inductively coupling RFID interrogator is disposed under the gaming surface below the first area, a second inductively coupling RFID interrogator is disposed under the gaming surface below the second area, a third inductively coupling RFID interrogator is disposed under the gaming surface below the third area.

19. The method of claim 18, wherein the step of discriminating further comprises: sequentially transmitting a first near-field inductively coupled interrogation signal, a second near-field inductively coupled interrogation signal, and a third near-field inductively coupled interrogation signal from the first inductively coupling RFID interrogator, the second inductively coupling RFID interrogator, and the third inductively coupling RFID interrogator, respectively; and responding on a chip-by-chip basis to each of the first near-field inductively coupled interrogation signal, the second near-field inductively coupled interrogation signal, and the third near-field inductively coupled interrogation signal by providing a received signal strength measurement for each of the near-field inductively coupled interrogation signals along with a gaming chip identifier.

20. The method of claim 19, wherein the step of associating further comprises: determining a gaming chip distance relative to each of the inductively coupled RFID interrogators based on their corresponding received signal strength measurements; determining an area location for each gaming chip in based on the step of determining; and forming a gaming chip table for the at least one reading zone, the gaming chip table including the gaming chip identifier, a monetary value, and an area designation for each gaming chip in the at least one reading zone.

21. The method of claim 20, wherein the at least one reading zone includes a plurality of reading zone distributed on the gaming surface.

22. The method of claim 20, wherein at least a portion of the gaming chips are constructed using side-by-side overlapping inductive coupler coils configured to measure a magnetic field gradient.

23. The method of claim 20, wherein at least a portion of the gaming chips are constructed using a single inductive coupler coil.

24. The method of claim 1, wherein the gaming surface is a black jack table that includes a plurality of coiled inductive interrogators disposed under the gaming surface in accordance with marked areas disposed on the gaming surface.

25. The method of claim 1, wherein at least a portion of the gaming chips are constructed using a single inductive coupler coil.

* * * * *